US012270091B2

(12) United States Patent
Hanum et al.

(10) Patent No.: US 12,270,091 B2
(45) Date of Patent: Apr. 8, 2025

(54) BORIDE-REINFORCED ALUMINUM-CONTAINING HIGH ENTROPY ALLOY COMPOSITION

(71) Applicant: General Electric Company, Schenectady, NY (US)

(72) Inventors: Sathisha Chikkabikkodu Hanum, Bengaluru (IN); Mohandas Nayak, Bengaluru (IN); Surinder Singh Pabla, Greer, SC (US); Biju Dasan, Bengaluru (IN)

(73) Assignee: GE Infrastructure Technology LLC, Greenville, SC (US)

( * ) Notice: Subject to any disclaimer, the term of this patent is extended or adjusted under 35 U.S.C. 154(b) by 854 days.

(21) Appl. No.: 17/727,093

(22) Filed: Apr. 22, 2022

(65) Prior Publication Data

US 2023/0287542 A1 Sep. 14, 2023

(30) Foreign Application Priority Data

Mar. 10, 2022 (IN) ..... 202211013112

(51) Int. Cl.

| | |
|---|---|
| ***C22C 32/00*** | (2006.01) |
| ***C22C 30/00*** | (2006.01) |
| ***C23C 28/00*** | (2006.01) |

(52) U.S. Cl.

CPC ..... *C22C 32/0073* (2013.01); *C22C 30/00* (2013.01); *C23C 28/324* (2013.01); *C23C 28/345* (2013.01)

(58) Field of Classification Search

None

See application file for complete search history.

(56) References Cited

U.S. PATENT DOCUMENTS

| | | | |
|---|---|---|---|
| 7,836,593 | B2 | 11/2010 | Allen |
| 2012/0082551 | A1 | 4/2012 | Macchia et al. |
| 2017/0016123 | A1 | 1/2017 | Schab et al. |

FOREIGN PATENT DOCUMENTS

| | | | |
|---|---|---|---|
| CN | 1858292 | A | 11/2006 |
| CN | 100507067 | C | 7/2009 |

(Continued)

OTHER PUBLICATIONS

Machine translation of CN 110643926A via EPO, translated Dec. 19, 2024. (Year: 2020).*

(Continued)

*Primary Examiner* — Elizabeth Collister

(74) *Attorney, Agent, or Firm* — James Pemrick; Charlotte Wilson; Hoffman Warnick LLC

(57) ABSTRACT

A composition, a machine component coated with the same, and a method of coating the machine component are provided. The composition includes a CoNiCrAlY alloy, where three or more elements of the CoNiCrAlY alloy are present in equimolar amounts, one of the three or more elements of the CoNiCrAlY alloy being aluminum (Al), and where a molar fraction of Al is between about 0.20 and about 0.25. The composition further includes a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$), and a refractory alloy.

20 Claims, 5 Drawing Sheets

(56) References Cited

FOREIGN PATENT DOCUMENTS

| | | | | |
|---|---|---|---|---|
| CN | 110643926 | A | * | 1/2020 |
| JP | 2005206930 | A | | 8/2005 |
| JP | 2005213605 | A | | 8/2005 |

OTHER PUBLICATIONS

U.S. Appl. No. 17/461,136 dated Aug. 30, 2021 entitled: "Oxidation and Wear Resistant Coating," 326819-US-1, 24 pages.
U.S. Appl. No. 17/473,281 dated Sep. 13, 2021 entitled: "Anti-Fretting Coating Composition and Coated Components," 506674-US-3, 24 pages.
European Search Report for corresponding EP Application No. 23157653.9 dated Jul. 12, 2023, 9 pages.
Huang et al., "Friction properties of high temperature boride coating under dry air and water vapor ambiences," Ceramics International 40 (2014) 12403-12411, published online at www.sciencedirect.com on Apr. 26, 2014.

* cited by examiner

| Comparison of weight percentage (wt %) of components in B-AlHEA Composition (based on the total weight of B-AlHEA Composition) | | | | | | |
|---|---|---|---|---|---|---|
| ID # | CoNiCrAlY (wt %) | Molar fraction of Al in CoNiCrAlxY | $Co_2B$ (wt %) | $Mo_2B$ (wt %) | MoNb (wt %) | M-Mo-Cr-Si (M=Ni or Co), wt % |
| 1 | 10-70 | 0.2-0.25 | 20-60 | ——— | 0.5-10 | ——— |
| 2 | 10-70 | 0.2-0.25 | ——— | 20-60 | 0.5-10 | ——— |
| 3 | 10-70 | 0.2-0.25 | 10-30 | 10-30 | 0.5-10 | ——— |
| 4 | 30 | 0.2-0.25 | 60 | ——— | 10 | ——— |
| 5 | 40 | 0.2-0.25 | ——— | 50 | 10 | ——— |
| 6 | 50 | 0.2-0.25 | 20 | 20 | 10 | ——— |
| 7 | 60 | 0.2-0.25 | 20 | 15 | 5 | ——— |
| 8 | 30-70 | 0.2-0.25 | 20-40 | ——— | ——— | 20-60 |
| 9 | 30-70 | 0.2-0.25 | ——— | 20-40 | ——— | 20-60 |
| 10 | 30-70 | 0.2-0.25 | 10-20 | 10-20 | | 20-60 |

FIG. 1

BORIDE-REINFORCED ALUMINUM-CONTAINING HIGH ENTROPY ALLOY COMPOSITION

BACKGROUND

The disclosure relates generally to a composition, a machine component coated with the same, and a method of coating the machine component. In particular, the disclosure relates generally to a boride-reinforced aluminum-containing high entropy alloy (B-AlHEA) composition, a machine component coated with the same, and a method of coating the machine component.

Gas turbine systems are mechanisms for converting potential energy, in the form of fuel, to thermal energy and then to mechanical energy for use in propelling aircraft, generating electric power, pumping fluids etc. Gas turbine systems include a compressor section for supplying a flow of compressed combustion air, a combustor section for burning fuel in the compressed combustion air, and a turbine section for extracting thermal energy from the combustion air and converting that energy into mechanical energy in the form of a rotating shaft. One available avenue for improving efficiency of gas turbine systems is use of higher operating temperatures.

However, metallic materials such as alloys used in gas turbine systems may be near the upper limits of their thermal stability at higher gas turbine operating temperatures. Modern high efficiency combustion gas turbine systems may have firing temperatures that exceed about 1,000° C., and even higher firing temperatures are expected as the demand for more efficient engines continues. Many components that form the "hot gas path" combustor and turbine sections are directly exposed to aggressive hot combustion gasses, for example, the combustor liner, the transition duct between the combustion and turbine sections, and the turbine stationary vanes and rotating blades and surrounding ring segments. In the hottest temperature portions of gas turbine systems, some metallic materials may be exposed to temperatures above their melting points.

In addition to thermal stresses discussed above, these and other components of gas turbine systems exposed to higher temperatures may experience mechanical stresses and loads that may cause mechanical wear to the components. For example, bucket interlocks of the gas turbine systems may be subjected to relatively high temperature (e.g., greater than 700° C., 800° C., or 900° C.) fretting motion, such as when the respective buckets lock up due to centrifugal and aerodynamic forces. The bucket interlocks may be subjected to fluttering, for example, during startup of the gas turbine, which may cause mechanical contact along the bucket interlocks.

Coatings are often applied to high temperature operating components, such as but are not limited to those in gas turbine systems. For example, ceramic materials are generally used as a thermal barrier coating. However, ceramic materials may still exhibit instability and decompose at relatively high temperatures, for example, above 900° C., thus not providing the full desired thermal barrier coating protection.

On the other hand, coatings used to provide improved mechanical wear resistance, for example, coating formed with Tribaloy® T-800® (Deloro Stellite Holdings Corporation, a Kennametal Company, Saint Louis, MO), a commercial alloy, tends to oxidize or gall at temperatures greater than 800° C., making them unsuitable for certain sections of engines that operate at temperatures greater than 800° C.

BRIEF DESCRIPTION

Certain embodiments are summarized below. These embodiments are not intended to limit the scope of the present disclosure, but rather these embodiments are intended only to provide a brief summary of possible forms of the disclosure. Indeed, the present system and method may encompass a variety of forms that may be similar to or different from the embodiments set forth below.

All aspects, examples and features mentioned below can be combined in any technically possible way.

An aspect of the disclosure provides a composition, comprising: a CoNiCrAlY alloy, wherein three or more elements of the CoNiCrAlY alloy are present in equimolar amounts, one of the three or more elements being aluminum (Al), and wherein a molar fraction of Al is between about 0.20 and about 0.25; a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy.

Another aspect of the disclosure includes any of the preceding aspects, and wherein the refractory alloy includes molybdenum niobium (MoNb).

Another aspect of the disclosure includes any of the preceding aspects, and wherein the composition includes, based on the total weight of the composition: between about 10% and about 70% by weight the CoNiCrAlY alloy; between about 20% and about 60% by weight the transition metal boride; and between about 0.5% and about 10% by weight MoNb.

Another aspect of the disclosure includes any of the preceding aspects, and wherein the refractory alloy includes M-Mo—Cr—Si, where M includes Ni or Co.

Another aspect of the disclosure includes any of the preceding aspects, and wherein the composition includes, based on the total weight of the composition: between about 30% and about 70% by weight the CoNiCrAlY alloy; between about 20% and about 40% by weight the transition metal boride; and between about 20% and about 60% by weight the refractory alloy.

Another aspect of the disclosure includes any of the preceding aspects, and wherein the composition includes a powder blend having an average particle size between about 0.1 microns (μm) and about 120 μm.

Another aspect of the disclosure includes any of the preceding aspects, and wherein the composition is configured to form a coating, the coating having a microstructure including: a sigma phase matrix including a plurality of particles of the CoNiCrAlY alloy; a laves phase uniformly dispersed in the sigma phase matrix, the laves phase including a plurality of particles of the transition metal boride; and a beta phase dispersed in the sigma phase matrix, the beta phase including a plurality of particles of the refractory alloy.

Another aspect of the disclosure includes any of the preceding aspects, and wherein the coating further includes an aluminum oxide layer formed above and across a region, the region including the sigma phase matrix, the laves phase, and the beta phase.

Another aspect of the disclosure includes any of the preceding aspects, and wherein the aluminum oxide layer has a thickness of less than about 20 microns (μm).

Another aspect of the disclosure provides a machine component comprising: a substrate having a coating thereon, the coating including: a CoNiCrAlY alloy, wherein three or more elements of the CoNiCrAlY alloy are present in equimolar amounts, one of the three or more elements being Al, and wherein a molar fraction of Al is between about 0.20 and about 0.25; a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy.

Another aspect of the disclosure includes any of the preceding aspects, and wherein the refractory alloy includes molybdenum niobium (MoNb).

Another aspect of the disclosure includes any of the preceding aspects, and wherein the composition includes, based on the total weight of the composition: between about 10% and about 70% by weight the CoNiCrAlY alloy; between about 20% and about 60% by weight the transition metal boride; and between about 0.5% and about 10% by weight MoNb.

Another aspect of the disclosure includes any of the preceding aspects, and wherein the refractory alloy includes M-Mo—Cr—Si, where M includes Ni or Co.

Another aspect of the disclosure includes any of the preceding aspects, and wherein the composition includes, based on the total weight of the composition: between about 30% and about 70% by weight the CoNiCrAlY alloy; between about 20% and about 40% by weight the transition metal boride; and between about 20% and about 60% by weight the refractory alloy.

Another aspect of the disclosure includes any of the preceding aspects, and wherein the composition includes a powder blend having an average particle size between about 0.1 microns (μm) and about 120 μm.

Another aspect of the disclosure includes any of the preceding aspects, and wherein the coating has a microstructure including: a sigma phase matrix including a plurality of particles of the CoNiCrAlY alloy; a laves phase substantially uniformly dispersed in the sigma phase matrix, the laves phase including a plurality of particles of the transition metal boride; and a beta phase dispersed in the sigma phase matrix, the beta phase including a plurality of particles of the refractory alloy.

Another aspect of the disclosure includes any of the preceding aspects, and wherein the coating further includes an aluminum oxide layer formed above and across a region, the region including the sigma phase matrix, the laves phase, and the beta phase.

Another aspect of the disclosure provides a method of coating a machine component, the method comprising: providing a composition that includes: a CoNiCrAlY alloy, wherein three or more elements of the CoNiCrAlY alloy are present in equimolar amounts, one of the three or more elements being Al, and wherein a molar fraction of Al is between about 0.20 and about 0.25; a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy; and applying the composition to a substrate of the machine component.

Another aspect of the disclosure includes any of the preceding aspects, and wherein the applying the composition includes forming a coating on the machine component, wherein the coating has a microstructure that includes: a sigma phase matrix including a plurality of particles of the CoNiCrAlY alloy; a laves phase uniformly dispersed in the sigma phase matrix, the laves phase including a plurality of particles of the transition metal boride; and a beta phase dispersed in the sigma phase matrix, the beta phase including a plurality of particles of the refractory alloy.

Another aspect of the disclosure includes any of the preceding aspects, and wherein the method further includes: thermally treating the coating; and forming an aluminum oxide layer above and across a region, the region including the sigma phase matrix, the laves phase, and the beta phase.

Two or more aspects described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which:

FIG. 1 is a table of various B-AlHEA compositions with constituents in weight percentage (wt %) based on the total weight of the B-AlHEA composition, according to embodiments of the disclosure;

Figure 2:
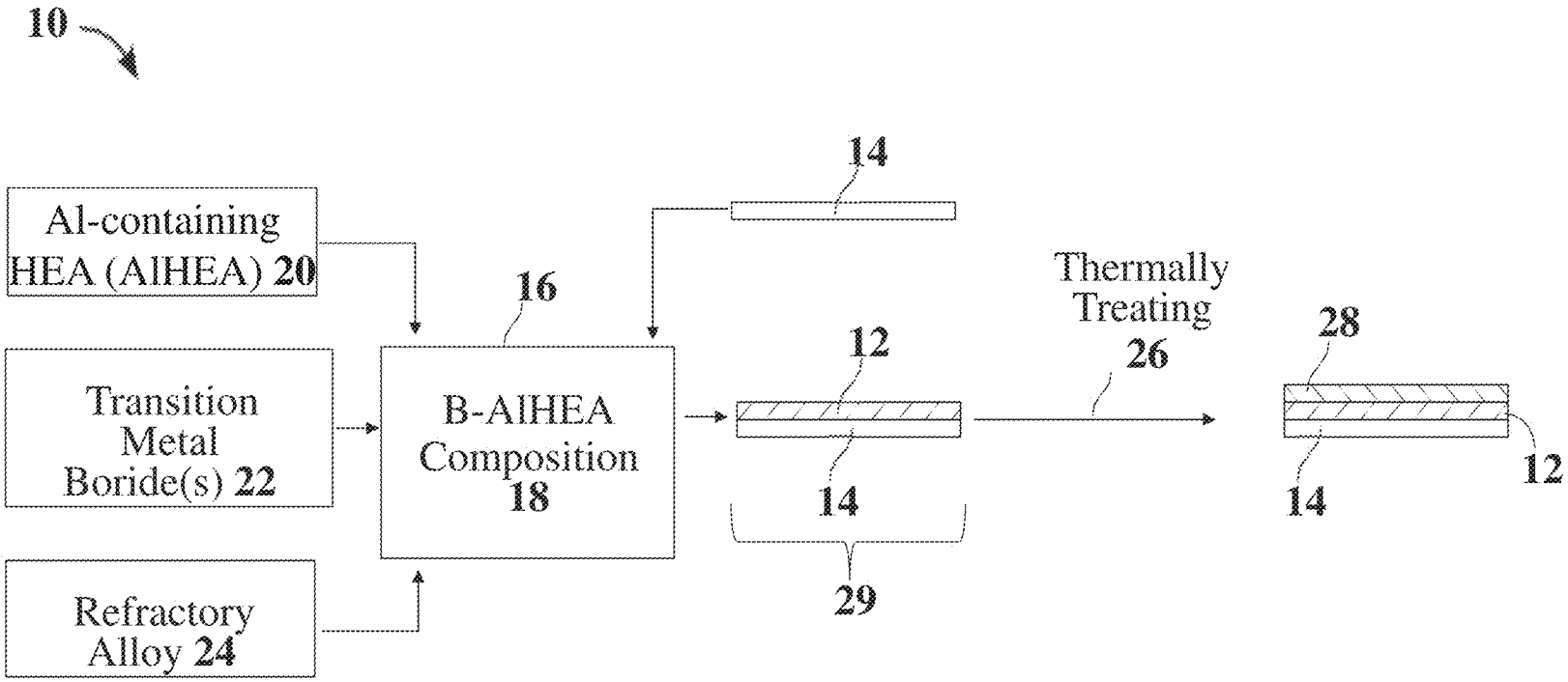
FIG. 2 is a schematic diagram of a process for forming a B-AlHEA composition and forming a coating from the B-AlHEA composition on a substrate of a machine component, according to embodiments of the disclosure.

It is noted that the drawings of the disclosure are not necessarily to scale. The drawings are intended to depict only typical aspects of the disclosure and therefore should not be considered as limiting the scope of the disclosure. In the drawings, like numbering represents like elements between the drawings.

DETAILED DESCRIPTION

As an initial matter, in order to clearly describe the subject matter of the current disclosure, it will become necessary to select certain terminology when referring to and describing relevant machine components within the current disclosure. To the extent possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

In addition, several descriptive terms may be used regularly herein, and it should prove helpful to define these terms at the onset of this section. These terms and their definitions, unless stated otherwise, are as follows.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. The terms "first", "second", and "third" may be used interchangeably to distinguish one component from another and are not intended to signify location or importance of the individual components. It will be further understood that the terms "comprises" and/or "comprising," when used in this specification, specify the presence of stated features, integers, steps, operations, elements, and/or components but do not preclude the presence or addition of one or more other features, integers, steps, operations, elements, components, and/or groups thereof "Optional" or "optionally" means that the subsequently described event or circumstance may or may not occur or that the subsequently describe component or element may or may not be present, and that the description includes instances where the event occurs or the component is present and instances where it does not or is not present.

Where an element or layer is referred to as being "on," "engaged to," "connected to" or "coupled to" another element or layer, it may be directly on, engaged to, connected to, or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

As discussed above, gas turbine systems convert potential energy to thermal energy and then to mechanical energy for use. Improving efficiency of a gas turbine is desirable and that improvement can be achieved by operating the gas turbine at higher temperatures. However, metallic materials used in gas turbines, especially at higher temperatures associated with hot gas path components may be near the upper limits of their thermal stability at gas turbine operating conditions. In the hottest portions of gas turbines, some metallic materials may even be exposed to temperatures above their melting points.

Currently available approaches may not be suitable for certain sections of gas turbine systems that operate at ultra-high temperatures (e.g., greater than 800° C., 900° C., 1000° C., 1100° C., 1200° C., 1300° C., or 1400° C., etc.). For example, when a gas turbine component coated with Tribaloy® T-800® alloy is exposed to temperatures greater than 800° C., chromium (Cr) and cobalt (Co) elements of the T-800® alloy are readily oxidized to form a thick layer of oxide scale including Cr and/or Co oxide. As oxide scale continues to form, more and more Cr and Co are consumed, leading to decreased amounts of the laves phases of T-800®. Laves phases of T-800® include $Co_2Mo_2Si$ and CoMoSi and are believed to impart wear resistance of the coating. As a result of oxidation, wear resistance of T-800® alloy coatings may decrease.

The present disclosure provides a composition that includes a boride-reinforced high entropy alloy (B-AlHEA) and a coating formed from the same. Compositions of the present disclosure and coatings formed therefrom can provide enhanced oxidation and wear resistance under ultra-high temperatures, for example, temperatures greater than 800° C., 900° C., 1000° C., 1100° C., 1200° C., 1300° C., or 1400° C., etc. Such compositions and coatings may be useful for hot gas path components in turbine machinery.

High entropy alloys (HEAs) provide a new type of design framework for developing alloys with enhanced high temperature capability. Typical high entropy alloys may include five or more metals of equimolar amounts/concentrations and may mainly include a single-phase structure, such as simple solid solutions (SSSs). HEAs were developed based on an assumption that a high entropy of mixing may help suppress the formation of intermetallic phases and stabilize a multicomponent single-phase solid solution of metals. While HEAs have potential for enhanced high temperature capability, by the nature of their design principles/assumptions, conventional HEAs may lack or have a low presence of intermetallic phases, including laves phases that may impart wear resistance to the coating.

The present disclosure provides a new class of composition of a boride-reinforced aluminum (Al)-containing HEA (B-AlHEA), that is, an aluminum (Al)-containing HEA (AlHEA) reinforced by transition metal boride(s). Compositions of the disclosure can have enhanced high temperature capability, for example, enhanced oxidation and wear resistance. In certain embodiments, B-AlHEA includes: a CoNiCrAlY alloy, where three or more elements of the CoNiCrAlY alloy are present in equimolar amounts, one of the three or more elements being Al, and where a molar fraction of Al is between about 0.20 and about 0.25; a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy.

B-AlHEA of the disclosure can provide enhanced oxidation resistance. Aluminum (Al) is present in CoNiCrAlY alloy as one of the three or more element in equimolar amounts and in a relatively high molar fraction (e.g., molar fraction of Al is about 0.20-0.25). When a machine component is coated with B-AlHEA and subjected to an ultra-high temperature environment (the ultra-high temperature in the disclosure refers to a temperature greater than 800° C., 900° C., 1000° C., 1100° C., 1200° C., 1300° C., or 1400° C., etc.), an entropy state of the alloy would favor formation of aluminum oxide over formation of chromium (Cr) and/or cobalt (Co) oxides. In other words, Al would be more readily oxidized than other metal elements, such as Cr and Co, in the coating formed with B-AlHEA composition. The resulting aluminum oxide ($Al_2O_3$) layer (Al oxide layer) is an oxidation layer that acts as a protective oxide layer. The protective oxide layer may prevent further destruction of intermetallic phases, including laves phases underneath the Al oxide layer in the coating microstructure, as will be discussed in detail with respect to FIG. 3. Therefore, the Al oxide layer resulting from coating with B-AlHEA may offer benefits of enhancing both oxidation resistance (for example, by minimizing oxidations of Cr and/or Co metals) and wear resistance (for example, by protecting laves phases underneath the Al oxide layer in the coating microstructure).

The AlHEA composition of the disclosure is reinforced by additives, such as but not limited to, transition metal boride(s). Without being bound by the theory, by reinforcing AlHEA with transition metal borides and forming B-AlHEA, more secondary hardening phases, such as laves phases including a plurality of particles of the transition metal borides, may be introduced into the microstructure of the B-AlHEA, thereby further enhancing the wear resistance of the B-AlHEA under ultra-high temperatures. In embodiments, the transition metal borides may include at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$).

B-AlHEA of the disclosure may further include a refractory alloy. The refractory alloy, in combination with other constituents of B-AlHEA, can impart more hardening phases to the microstructure of B-AlHEA, thereby further enhancing wear resistance. In certain embodiments, the refractory alloy may include molybdenum niobium (MoNb). In some embodiments, the refractory alloy may include M-Mo—Cr—Si, where M includes Ni or Co, or a combination thereof. In some embodiments, the M-Mo—Cr—Si alloy may include Co—Mo—Cr—Si. In embodiments, the M-Mo—Cr—Si alloy may include T-800®.

FIG. 1 is a table of various B-AlHEA compositions, as embodied by the disclosure. B-AlHEA compositions include a CoNiCrAlY alloy, where three or more elements of the CoNiCrAlY alloy are present in equimolar amounts, one of the three or more elements being Al, and where a molar fraction of Al is between about 0.20 and about 0.25. B-AlHEA compositions further include a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$). Additionally, B-AlHEA compositions include a refractory alloy. The refractory alloy may be molybdenum niobium (MoNb), or M-Mo—Cr—Si, where M includes Ni or Co, or a combination thereof. In some embodiments, M-Mo—Cr—Si alloy may include Co—Mo—Cr—Si. In embodiments, the M-Mo—Cr—Si alloy may include T-800®. It is to be understood that the table of FIG. 1 serves the purpose of describing certain embodiments only and is not intended to be limiting of the disclosure. For example, while certain weight percentage of the CoNiCrAlY alloy are included in the examples for illustration purposes, it is to be understood that other weight percentage ranges of the CoNiCrAlY alloy as disclosed in detail below, may be used in other embodiments. In addition, while $Co_2B$ and $Mo_2B$ are listed in FIG. 1 for illustration purposes, other transition metal borides, for example, titanium boride ($TiB_2$), zirconium boride ($ZrB_2$), tantalum boride ($TaB_2$), or niobium boride ($NiB_2$), may replace $Co_2B$ and/or $Mo_2B$ to form other embodiments of B-AlHEA compositions.

In certain embodiments, the elements of the CoNiCrAlY alloy present in equimolar amounts may be cobalt (Co), nickel (Ni), chromium (Cr), aluminum (Al), and yttrium (Y) in a molar ratio of 1:1:1:1:1. However, it is to be understood that the formula CoNiCrAlY used in the disclosure is a generic formula and is not limited to the embodiment where the molar ratio between elements Co:Ni:Cr:Al:Y is 1:1:1:1:1. Rather, the formula CoNiCrAlY may also include embodiments where the molar ratio between Co:Ni:Cr:Al:Y may be adjusted as long as three or more elements of the CoNiCrAlY alloy are present in equimolar amounts, one of the three or more elements being Al, and where a molar fraction of Al is between about 0.20 and about 0.25. For example, in some embodiments, the three or more elements of the CoNiCrAlY alloy present in equimolar amounts may be Co, Ni, and Al, and the formula may be $Co_aNi_bCr_cAl_dY_e$ where a, b, d has the same value and in a range of about 0.20 and about 0.25, and where a+b+c+d+e=1. In other embodiments, the three or more elements of the CoNiCrAlY alloy present in equimolar amounts may be Ni, Cr, and Al, and the formula may be $Co_aNi_bCr_cAl_dY_e$ where b, c, d has the same value and in a range of about 0.20 and about 0.25, and where a+b+c+d+e=1. The three or more elements of the CoNiCrAlY alloy present in equimolar amounts may also be Co, Cr, and Al, and the formula may be $Co_aNi_bCr_cAl_dY_e$ where a, c, d has the same value and in a range of about 0.20 and about 0.25, and where a+b+c+d+e=1. In some embodiments, the three or more elements of the CoNiCrAlY alloy present in equimolar amounts may be selected from cobalt (Co), nickel (Ni), chromium (Cr), aluminum (Al), and yttrium (Y), and the formula may be $Co_aNi_bCr_cAl_dY_e$ where each of a, b, c, d and e is about 0.20. The molar fraction of Al in the CoNiCrAlY may be about 0.20, 0.21, 0.22, 0.23, 0.24, 0.25, including ranges between any two numerical values in the list.

In embodiments, the weight percentage of the CoNiCrAlY alloy in the composition may be between about 10% and about 70%, such as about 10%, about 15%, about 20%, about 25%, about 30%, about 35%, about 40%, about 45%, about 50%, about 55%, about 60%, about 65%, about 70%, including ranges between any two of the above values. For example, in some embodiments, the CoNiCrAlY alloy may be present in between about 10% and about 70% by weight, or about 20% and about 60% by weight, or about 40% and about 70% by weight, based on the total weight of the B-AlHEA composition.

The transition metal boride(s) may be present in between about 20% and about 60% by weight in the composition. In embodiments, a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$). In embodiments, as illustrated as non-limiting examples in FIG. 1, transition metal boride(s) may be at least one of $Co_2B$ and $Mo_2B$, for example, $Co_2B$ or $Mo_2B$ or a combination thereof. In embodiments, the weight percentage of the at least one of $Co_2B$ and $Mo_2B$ in the composition may be between about 20% and about 60%, such as about 20%, about 25%, about 30%, about 35%, about 40%, about 45%, about 50%, about 55%, about 60%, including ranges between any two of the above values. For example, in some embodiments, the boride(s) may also be present in between about 30% and about 50% by weight, or about 20% and about 40% by weight in the B-AlHEA composition.

In embodiments, the refractory alloy may be MoNb or M-Mo—Cr—Si, where M includes Ni or Co. For example, in some embodiments, the refractory alloy may be MoNb present in between about 0.5% and about 10% by weight based on the total weight of the B-AlHEA composition. In embodiments, the weight percentage of MoNb in the composition may be about 0.5%, about 1%, about 2%, about 3%, about 4%, about 5%, about 10%, about 15%, about 20%, about 25%, about 30%, about 35%, about 40%, about 45%, including ranges between any two of the above values. In other embodiments, the refractory alloy may be M—Mo—Cr—Si, where M includes Ni or Co. For example, in some embodiments, the refractory alloy may be M—Mo—Cr—Si present in between about 20% and about 60% by weight, about 30% and about 50% by weight, or about 20% and about 40% by weight in the B-AlHEA composition. In embodiments, the weight percentage of MoNb in the composition may be about 20%, about 25%, about 30%, about 35%, about 40%, about 45%, about 50%, about 55%, about 60%, including ranges between any two of the above values.

FIG. 1 lists various B-AlHEA compositions including constituents shown in weight percentage based on the total weight of the B-AlHEA composition. For example, as illustrated in Examples 1-7 of FIG. 1, B-AlHEA composition may include a CoNiCrAlY alloy where a molar fraction of Al is between about 0.20 and about 0.25; at least one of cobalt boride ($Co_2B$) and molybdenum boride ($Mo_2B$); and a refractory alloy including molybdenum niobium (MoNb). The B-AlHEA compositions may include, based on the total weight of the B-AlHEA composition, between about 10% and about 70% by weight the CoNiCrAlY alloy; between about 20% and about 60% by weight at least one of $Co_2B$ and $Mo_2B$; and between about 0.5% and about 10% by weight MoNb.

As illustrated in Examples 8-10, the refractory alloy may include M—Mo—Cr—Si, where M includes Ni or Co, and the compositions may include, based on the total weight of the composition, between about 30% and about 70% by weight the CoNiCrAlY alloy where a molar fraction of Al is between about 0.20 and about 0.25; between about 20% and about 40% by weight at least one of $Co_2B$ and $Mo_2B$; and between about 20% and about 60% by weight M—Mo—Cr—Si, where M includes Ni or Co.

FIG. 2 is a schematic diagram of an embodiment of a process 10 for forming a B-AlHEA composition 18 and producing a coating 12 formed from B-AlHEA composition 18 on a substrate 14 (e.g., a machine component). Coating 12 enhances oxidation and mechanical wear resistance of substrate 14. Substrate 14 may be a component of a gas turbine, such as part of a combustion section, bucket, bucket interlock, or another component of the gas turbine that may be subjected to ultra-high temperatures (e.g., greater than 800° C.) and mechanical contact during operation. The steps illustrated in the process 10 are meant to serve the purpose of describing certain embodiments only and are not intended to limit the scope of this disclosure, because additional steps may be performed, certain steps may be omitted, and the illustrated steps may be performed in an alternative order or in parallel, where appropriate.

To start process 10, at block 16, a B-AlHEA composition 18 is formed. B-AlHEA composition 18 may be formed as a mixture of Al-containing high entropy alloy (AlHEA) 20, transition metal boride(s) 22, and a refractory alloy 24. That is, B-AlHEA composition 18 may be formed by blending AlHEA 20 with transition metal boride(s) 22 and refractory alloy 24. B-AlHEA composition may be formed as a mixture that includes, based on the total weight of the B-AlHEA composition, between about 10% and about 70% by weight AlHEA 20, between about 20% and about 60% by weight transition metal boride(s) 22, and between about 0.5% and about 60% by weight refractory alloy 24. In some embodiments, AlHEA 20 includes a CoNiCrAlY alloy, where three or more elements of the CoNiCrAlY alloy are present in equimolar amounts, one of the three or more elements of the CoNiCrAlY alloy being Al, and a molar fraction of Al is between about 0.20 and about 0.25. Transition metal boride(s) 22 may include at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$). In certain embodiments, transition metal boride(s) 22 may include at least one of cobalt boride ($Co_2B$) and molybdenum boride ($Mo_2B$). In certain embodiments, the refractory alloy may include molybdenum niobium (MoNb). In some embodiments, the refractory alloy may include M—Mo—Cr—Si, where M includes Ni or Co. In some embodiments, M—Mo—Cr—Si alloy may include Co—Mo—Cr—Si. In embodiments, the M—Mo—Cr—Si alloy may include T-800®.

In embodiments, AlHEA 20, transition metal boride(s) 22, and/or refractory alloy 24 may be particles, where the particles may have a distribution of sizes (e.g., micron-sized particles, nanoparticles, or larger-sized particles) and shapes. For example, the micron-sized particles may be 10%, 20%, 30%, 40%, 50%, 60%, 70%, 80%, 90%, or 95% spherical, and the nano-size particles may be 10%, 20%, 30%, 40%, 50%, 60%, 70%, 80%, 90%, or 95% spherical.

B-AlHEA composition 18 may be provided in a powder form. The average particle size of B-AlHEA composition 18 may be measured by any currently known or later developed techniques for particle size analysis including, but are not limited to, dynamic light scattering (DLS), dynamic and static image analysis, sieve analysis, sedimentation, electrooptic scattering, and laser diffraction (LD), etc. If it is determined that the average particle size of B-AlHEA composition 18 is greater than a predefined average particle size range, B-AlHEA composition 18 may be further processed (e.g., high energy milling (ball/roller), vibro milling, etc.) to bring its average particle size to be within the predefined average particle size range. In certain embodiments, the predefined average particle size range is between about 0.1 microns (μm) and about 120 μm. Alternatively, one or more of AlHEA alloy 20, transition metal boride(s) 22, or refractory alloy 24 may be pre-processed (e.g., milling) to bring their respective average particle sizes to be within the predefined average particle size range of between about 0.1 microns (μm) and about 120 μm, before AlHEA alloy 20, transition metal boride(s) 22, and refractory alloy 24 are blended or mixed to form B-AlHEA composition 18. After the process at block 16, B-AlHEA composition 18 may be obtained in a powder blend having an average particle size range between about 0.1 μm and about 120 μm. In embodiments, the predefined average particle size range is between about 5 microns (μm) and about 70 μm, or between about 15 μm and about 45 μm, or preferably between about 25 μm and about 70 μm.

B-AlHEA composition 18 is then applied or deposited onto substrate 14, such as to one or more surfaces of substrate 14. In some embodiments, B-AlHEA composition 18 may be applied to the one or more surfaces of substrate 14 using any currently known or later developed deposition techniques including, but are not limited to, thermal spraying (e.g., plasma, flame, high velocity oxygen fuel (HVOF)), and high velocity air fuel (HVAF) spray), sputtering, and electron beam physical vapor deposition (EBPVD), etc.

The applying of B-AlHEA composition 18 onto substrate 14 (e.g., using a thermal spray) produces coating 12. At step 26, coating 12 is thermally treated (e.g., heated). Thermally treating coating 12 may precipitate sub-micrometric crystalline intermetallic phases (e.g., from B-AlHEA composition 18) present in coating 12 and may provide enhanced wear resistance at temperatures greater than approximately 900° C. Thermally treating coating 12 can also generate an Al oxide layer 28 formed thereon. As will be discussed in detail with respect to FIG. 3, Al oxide layer 28 is an oxidation layer, which can act as a protective oxide layer to prevent the destruction of intermetallic phases, including laves phases present in coating 12, under ultra-high temperatures. Al oxide layer 28 offers benefits of enhancing both oxidation resistance (for example, by minimizing oxidation of Cr and Co metals) and wear resistance (for example, by protecting laves phases underneath Al oxide layer 28 in the microstructure of the formed coating 12).

Thermally treating coating 12 may include heating coating 12 (and substrate 14 or machine component 29 coated with coating 12) to a relatively high temperature, such as approximately 500° C., 600° C., 700° C., 800° C., 900° C., or greater than 900° C. for a predetermined time period. In certain embodiments, thermally treating coating 12 includes heating coating 12 to a temperature greater than 800° C. for a predetermined time period. The predetermined time period may be 1 hour, 5 hours, 10 hours, 20 hours, or greater than 20 hours. At least in some instances, thermally treating coating 12 may include heating the coating 12 in a furnace capable of reaching the relatively high temperatures listed above. In some embodiments, thermally treating coating 12 may include operating the machine (e.g., the gas turbine) with one or more surfaces of the component of the machine coated with coating, and thus facilitating formation of Al oxide layer 28 during operation.

In certain embodiments, machine component 29 includes substrate 14 having coating 12 thereon. In embodiments, coating 12 includes: a CoNiCrAlY alloy, where three or more elements of the CoNiCrAlY alloy are present in equimolar amounts, one of the three or more elements of the CoNiCrAlY alloy being Al, and where a molar fraction of Al is between about 0.20 and about 0.25. The composition further includes a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$), and a refractory alloy. Coating 12 may further include Al oxide layer 28 formed thereon.

Figure 3:
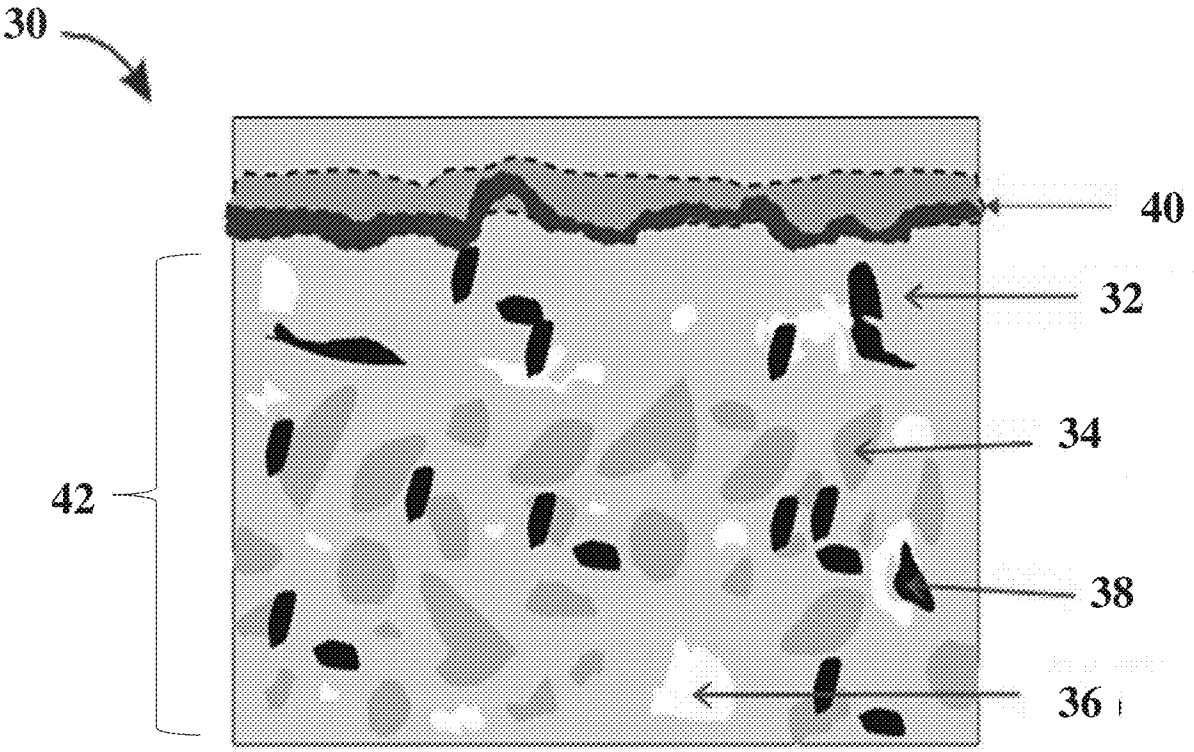
FIG. 3 is a schematic diagram of a microstructure of a coating formed from a B-AlHEA composition, according to embodiments of the disclosure.

FIG. 3 illustrates a schematic diagram of a microstructure 30 of a coating formed from B-AlHEA composition 18, as embodied by the disclosure. Microstructure 30 may be evaluated using any currently known or later developed microstructural analysis techniques including, but are not limited to, scanning electron microscopy (SEM), optical microscope, etc. In FIG. 3, a non-limiting example is illustrated. In FIG. 3, microstructure 30 of coating 12 (FIG. 2) may include a sigma phase matrix 32, a laves phase 34 uniformly dispersed in sigma phase matrix 32, and a beta phase 36 dispersed in sigma phase matrix 32. In some embodiments, sigma phase matrix 32 may include CoNiCrAlY alloy, where three or more elements are present in equimolar amounts, one of the three or more elements of the CoNiCrAlY alloy being Al, and a molar fraction of Al is between about 0.20 and about 0.25. Laves phase 34 may include a plurality of particles of transition metal boride(s) 38 (also see transition metal boride(s) 22, FIG. 2). Beta phase 36 may include a plurality of particles of refractory alloy 24 (FIG. 2).

Microstructure 30 may further include an aluminum oxide layer 40 (also see Al oxide layer 28, FIG. 2). As discussed with respect to FIG. 2, Al oxide layer 28, 40 may be formed when coating 12 is subjected to a temperature (e.g., greater than 800° C.) for a predetermined time period. Al oxide layer 28, 40 may be formed above and across a region 42 of microstructure 30 that includes sigma phase matrix 32, laves phase 34, and beta phase 36. Therefore, Al oxide layer 28, 40 may serve as a protective layer that protects the intermetallic phases in region 42 underneath Al oxide layer 28, 40. For example, Al oxide layer 28, 40 protects laves phase 34 that includes a plurality of particles of transition metal boride(s) 22, 38, thereby providing additional benefits of enhanced wear resistance under ultra-high temperatures. In some embodiments, Al oxide layer 28, 40 has a thickness of less than 20 μm. Furthermore, transition metal boride(s) 22, 38 may additionally provide enhanced wear resistance under ultra-high temperatures.

Figure 4:
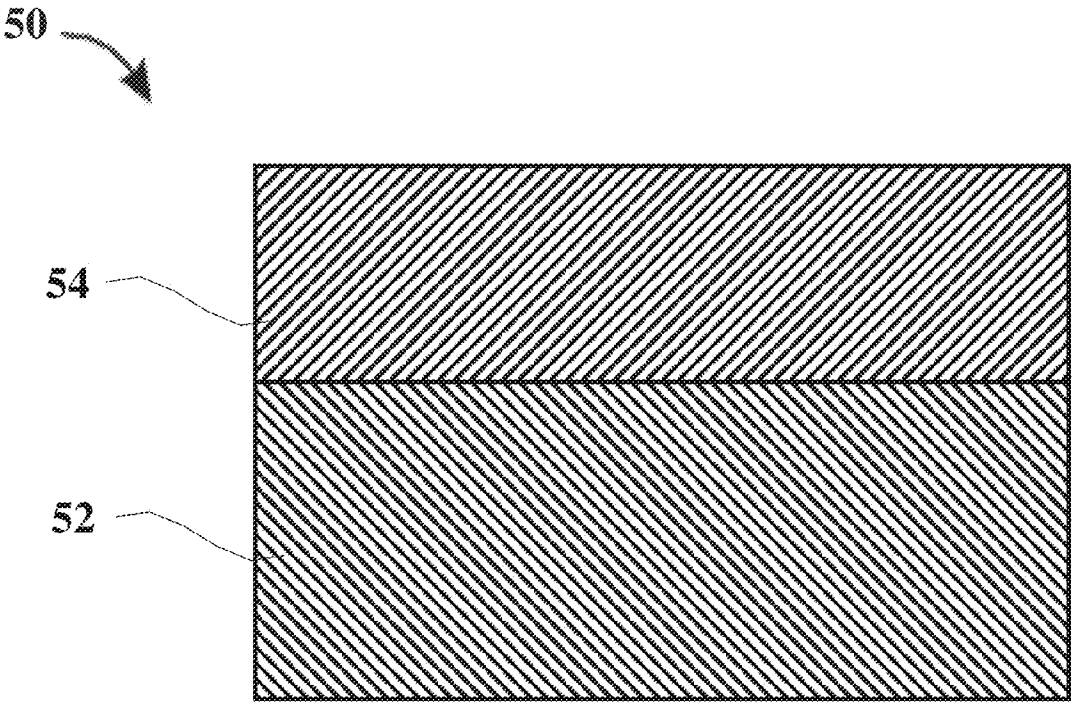
FIG. 4 is a schematic sectional view of a machine component with a coating formed thereon from a B-AlHEA composition, according to embodiments of the disclosure.

FIG. 4 is a schematic sectional view of a machine component 50 (also see machine component 29, FIG. 2) including a substrate 52 having coating 54 thereon, according to the disclosure. Coating 54 (also see coating 12, FIG. 2) is formed from B-AlHEA composition 18 (FIG. 2). Further, coating 12, 54 can be provided as a protective layer on substrate 52 (also see substrate 14, FIG. 2). In certain embodiments, machine component 29, 50 includes substrate 14, 52 having a coating 12, 54 thereon. In some embodiments, coating 12, 54 include: a CoNiCrAlY alloy, where three or more elements of the CoNiCrAlY alloy are present in equimolar amounts, one of the three or more elements being Al, and a molar fraction of Al is between about 0.20 and about 0.25; a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$), and a refractory alloy. Component 50 may be subjected to ultra-high temperatures, for example temperatures encountered by a hot gas path component in turbines. Turbines may include, but are not limited to, land-based gas turbines. Hot gas path components include, but are not limited to, combustion liners, transition pieces, turbine nozzles, and turbine blades (also known as "turbine buckets").

Figure 5:
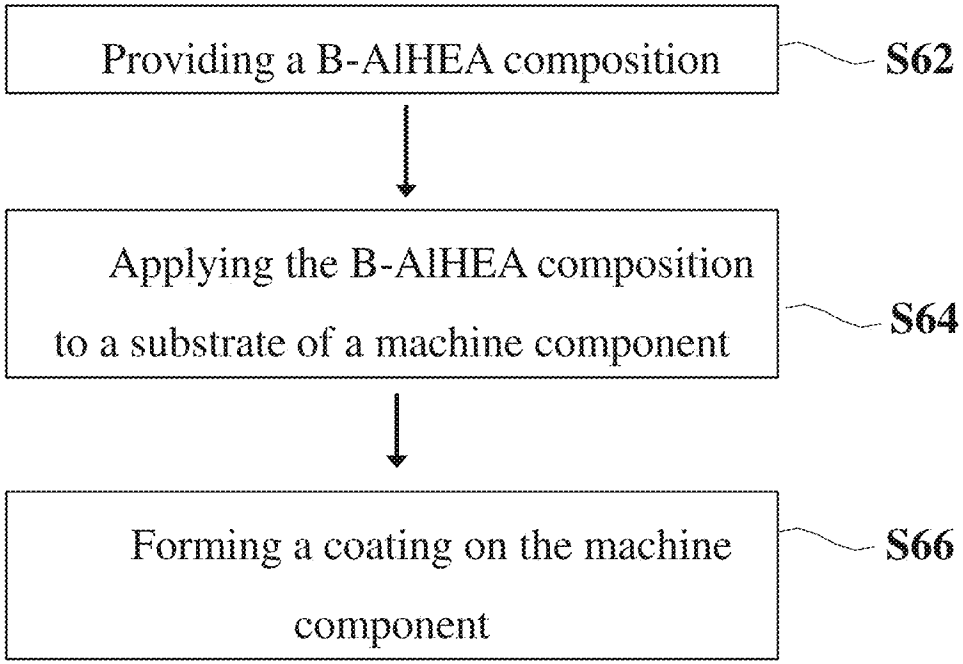
FIG. 5 is a flow diagram of a method of coating a machine component with a B-AlHEA coated thereon, according to embodiments of the disclosure.

FIG. 5 is a flow diagram of a method of coating machine component 29, 50.

With further reference to FIGS. 2 and 4, the method includes providing B-AlHEA composition 18 at step S62, applying B-AlHEA composition 18 to substrate 14, 52 of machine component 29, 50 at step S64, and forming coating 12, 54 on substrate 14, 52 at step S66. The providing B-AlHEA composition 18 (step S62) further includes forming B-AlHEA composition 18 by mixing or blending the following: a CoNiCrAlY alloy, where three or more elements of the CoNiCrAlY alloy are present in equimolar amounts, one of the three or more elements being Al, and a molar fraction of Al is between about 0.20 and about 0.25; a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$), and a refractory alloy. Forming B-AlHEA composition 18 may include controlling average particle size range of B-AlHEA composition 18 to be between about 0.1 μm and about 120 μm. Forming B-AlHEA composition 18 may optionally include adjusting (e.g., milling) particles of one or more of: the CoNiCrAlY alloy, the transition metal boride, and the refractory alloy, before mixing or blending such that each respective average particle size is within a preferred average particle size range of between about 0.1 μm and about 120 μm. In certain embodiments, B-AlHEA composition 18 is formed in a powder blend having an average particle size between about 0.1 microns (μm) and about 120 μm. In embodiments, the average particle size range is between about 5 microns (μm) and about 70 μm, or between about 15 μm and about 45 μm, or preferably between about 25 μm and about 70 μm.

With further reference to FIGS. 2 and 5, applying B-AlHEA composition 18 to substrate 14, 52 (step S64) may include applying or depositing B-AlHEA composition 18 onto one or more surfaces of substrate 14, 52 using currently known or later developed deposition techniques including, but are not limited to, thermal spraying (e.g., plasma, flame, and high velocity oxygen fuel (HVOF)), high velocity air fuel (HVAF) spray), sputtering, and electron beam physical vapor deposition (EBPVD), or combinations thereof.

Applying B-AlHEA composition 18 onto substrate 14, 52 (e.g., using a thermal spray) forms coating 12, 54. Coating 12, 54 of machine component 29, 50 may include microstructure 30 (FIG. 3) that includes sigma phase matrix 32, laves phase 34 uniformly dispersed in sigma phase matrix 32, beta phase 36 dispersed in sigma phase matrix 32. In some embodiments, sigma phase matrix 32 may include CoNiCrAlY alloy, where three or more elements of the CoNiCrAlY alloy are present in equimolar amounts, one of the three or more elements being Al, and a molar fraction of Al is between about 0.20 and about 0.25. Laves phase 34 may include a plurality of particles of transition metal boride(s) 38 (also see transition metal boride(s) 22, FIG. 2), where transition metal boride(s) 22, 38 include at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$). In embodiments, transition metal boride(s) 22, 38 include at least one of: cobalt boride ($Co_2B$) and molybdenum boride ($Mo_2B$). Beta phase 36 may include a plurality of particles of refractory alloy 24 (FIG. 2).

With further reference to FIGS. 2-4, forming coating 12, 54 on substrate 52 (S66) may additionally include thermally treating coating 12, 54 (e.g., heating) to generate Al oxide layer 28, 40. Al oxide layer 28, 40 may be formed above and across a region 42 including sigma phase matrix 32, laves phase 34, and beta phase 36. In some embodiments, Al oxide layer 28, 40 may have a thickness of less than about 20 μm.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value as specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise. "Approximately" and "about," as applied to a particular value of a range, applies to both end values and, unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application and to enable others of ordinary skill in the art to understand the disclosure for various embodiments with various modifications as are suited to the particular use contemplated.

What is claimed is:

1. A composition, comprising:

a CoNiCrAlY alloy, wherein three or more elements of the CoNiCrAlY alloy are present in equimolar amounts, one of the three or more elements of the CoNiCrAlY alloy being aluminum (Al), and wherein a molar fraction of Al is between about 0.20 and about 0.25;

a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy.

2. The composition of claim 1, wherein the refractory alloy includes molybdenum niobium (MoNb).

3. The composition of claim 2, wherein the composition includes, based on the total weight of the composition:

between about 10% and about 70% by weight the CoNiCrAlY alloy;

between about 20% and about 60% by weight the transition metal boride;

between about 0.5% and about 10% by weight MoNb.

4. The composition of claim 1, wherein the refractory alloy includes M—Mo—Cr—Si, where M includes Ni or Co.

5. The composition of claim 4, wherein the composition includes, based on the total weight of the composition:

between about 30% and about 70% by weight the CoNiCrAlY alloy;

between about 20% and about 40% by weight the transition metal boride; and between about 20% and about 60% by weight the refractory alloy.

6. The composition of claim 1, wherein the composition includes a powder blend having an average particle size between about 0.1 microns (μm) and about 120 μm.

7. The composition of claim 1, wherein the composition is configured to form a coating having a microstructure including:

a sigma phase matrix including a plurality of particles of the CoNiCrAlY alloy;

a laves phase uniformly dispersed in the sigma phase matrix, the laves phase including a plurality of particles of the transition metal boride; and a beta phase dispersed in the sigma phase matrix, the beta phase including a plurality of particles of the refractory alloy.

8. The composition of claim 7, wherein the coating further includes an aluminum oxide layer formed above and across a region, the region including the sigma phase matrix, the laves phase, and the beta phase.

9. The composition of claim 8, wherein the aluminum oxide layer has a thickness of less than about 20 microns (μm).

10. A machine component comprising:

a substrate having a coating thereon, the coating including:

a CoNiCrAlY alloy, wherein three or more elements of the CoNiCrAlY alloy are present in equimolar amounts, one of the three or more elements of the CoNiCrAlY alloy being Al, and wherein a molar fraction of Al is between about 0.20 and about 0.25;

a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy.

11. The machine component of claim 10, wherein the refractory alloy includes molybdenum niobium (MoNb).

12. The machine component of claim 11, wherein the composition includes, based on the total weight of the composition:

between about 10% and about 70% by weight the CoNiCrAlY alloy;

between about 20% and about 60% by weight the transition metal boride; and between about 0.5% and about 10% by weight MoNb.

13. The composition of claim 10, wherein the refractory alloy includes M—Mo—Cr—Si, where M includes Ni or Co.

14. The machine component of claim 13, wherein the composition includes, based on the total weight of the composition:

between about 30% and about 70% by weight the CoNiCrAlY alloy;

between about 20% and about 40% by weight the transition metal boride; and between about 20% and about 60% by weight of the refractory alloy.

15. The machine component of claim 10, wherein the composition includes a powder blend having an average particle size between about 0.1 microns (μm) and about 120 μm.

16. The machine component of claim 10, wherein the coating has a microstructure including:

a sigma phase matrix including a plurality of particles of the CoNiCrAlY alloy;

a laves phase substantially uniformly dispersed in the sigma phase matrix, the laves phase including a plurality of particles of the transition metal boride; and a beta phase dispersed in the sigma phase matrix, the beta phase including a plurality of particles of the refractory alloy.

17. The machine component of claim 16, wherein the coating further includes an aluminum oxide layer formed above and across a region, the region including the sigma phase matrix, the laves phase, and the beta phase.

18. A method of coating a machine component thereon, the method comprising:

providing a composition that includes:

a CoNiCrAlY alloy, wherein three or more elements of the CoNiCrAlY alloy are present in equimolar amounts, one of the three or more elements of the CoNiCrAlY alloy being Al, and wherein a molar fraction of Al is between about 0.20 and about 0.25;

a transition metal boride including at least one of: cobalt boride ($Co_2B$), titanium boride ($TiB_2$), zirconium boride ($ZrB_2$), tantalum boride ($TaB_2$), niobium boride ($NiB_2$), or molybdenum boride ($Mo_2B$); and a refractory alloy; and applying the composition to a substrate of the machine component.

19. The method of claim 18, the applying the composition includes forming a coating on the machine component, wherein the coating has a microstructure that includes:

a sigma phase matrix including a plurality of particles of the CoNiCrAlY alloy;

a laves phase uniformly dispersed in the sigma phase matrix, the laves phase including a plurality of particles of the transition metal boride; and a beta phase dispersed in the sigma phase matrix, the beta phase including a plurality of particles of the refractory alloy.

20. The method of claim 19, wherein the method further includes:

thermally treating the coating; and forming an aluminum oxide layer above and across a region, the region including the sigma phase matrix, the laves phase, and the beta phase.

* * * * *